US006006691A

United States Patent [19]

Wilce

[11] Patent Number: 6,006,691

[45] Date of Patent: Dec. 28, 1999

[54] KNOCK-DOWN BOAT ASSEMBLY

[76] Inventor: Stephen E. Wilce, P. O. Box 962, Winters, Calif. 95694

[21] Appl. No.: 08/890,746

[22] Filed: Jul. 11, 1997

[51] Int. Cl.[6] ..... B63B 7/00

[52] U.S. Cl. ..... 114/353

[58] Field of Search ..... 114/61, 352–354, 114/102, 103; 441/64–66; 135/121; 160/264, 395, 402

[56] References Cited

U.S. PATENT DOCUMENTS

| | | | |
|---|---|---|---|
| 2,277,742 | 3/1942 | Crawford | 135/121 |
| 2,816,299 | 12/1957 | Holladay | 441/66 |
| 2,977,606 | 4/1961 | Straussler | 114/353 |
| 2,999,253 | 9/1961 | Lewis | 114/347 |
| 3,049,731 | 8/1962 | Ertl et al. . | |
| 3,108,295 | 10/1963 | Schor et al. . | |
| 3,116,496 | 1/1964 | Straussler | 114/354 |
| 3,134,113 | 5/1964 | Boyington et al. | 114/61 |
| 3,490,109 | 1/1970 | Heimberger . | |
| 3,529,312 | 9/1970 | Robinsky . | |
| 3,657,753 | 4/1972 | Le Blanc, Sr. | 441/66 |
| 3,748,670 | 7/1973 | Musson . | |
| 3,795,926 | 3/1974 | Hoshino . | |
| 3,924,305 | 12/1975 | Hamamura . | |
| 4,130,917 | 12/1978 | Shopalovich . | |
| 4,290,157 | 9/1981 | Jensen, Jr. . | |
| 4,308,644 | 1/1982 | Brown . | |
| 4,658,480 | 4/1987 | Morioka . | |
| 4,706,597 | 11/1987 | Figone . | |
| 4,913,077 | 4/1990 | Bectarte . | |
| 4,941,238 | 7/1990 | Clark . | |
| 5,231,736 | 8/1993 | Hohenocker et al. . | |

*Primary Examiner*—Ed Swinehart

[57] ABSTRACT

A folding boat assembly includes a hull assembly comprised of a pair of flexible hull panels joined at confronting keel edges by a flexible hinge that permits folding the hull panels together and rolling the hull panels into a storage package. An internal frame assembly for supporting the hull includes a pair of cam-action frame assemblies disposed generally amidship to define the hull curvature and apply tension to the hull between the gunwales. A cockpit coaming is supported at opposed ends by the cam-action frame assemblies and defines a passenger cockpit. A pair of longitudinal strut assemblies extend from the cockpit coaming fore and aft to engage the bow and stern to absorb longitudinal compression forces and transmit them to the cockpit coaming. A deck assembly extends across the gunwales from the bow and stern to the midship area, and may comprise a flexible waterproof fabric. A sealed zipper closure each the deck assembly permits access to install and remove the frame assemblies and longitudinal strut assemblies. The decks may comprise form-retaining panels secured to the gunwale edges by sealed zipper closures. A plurality of panel stiffeners are secured to the hull panels to provide increased stiffness and rigidity to selected portions of the hull panels.

66 Claims, 9 Drawing Sheets

FIG. 3
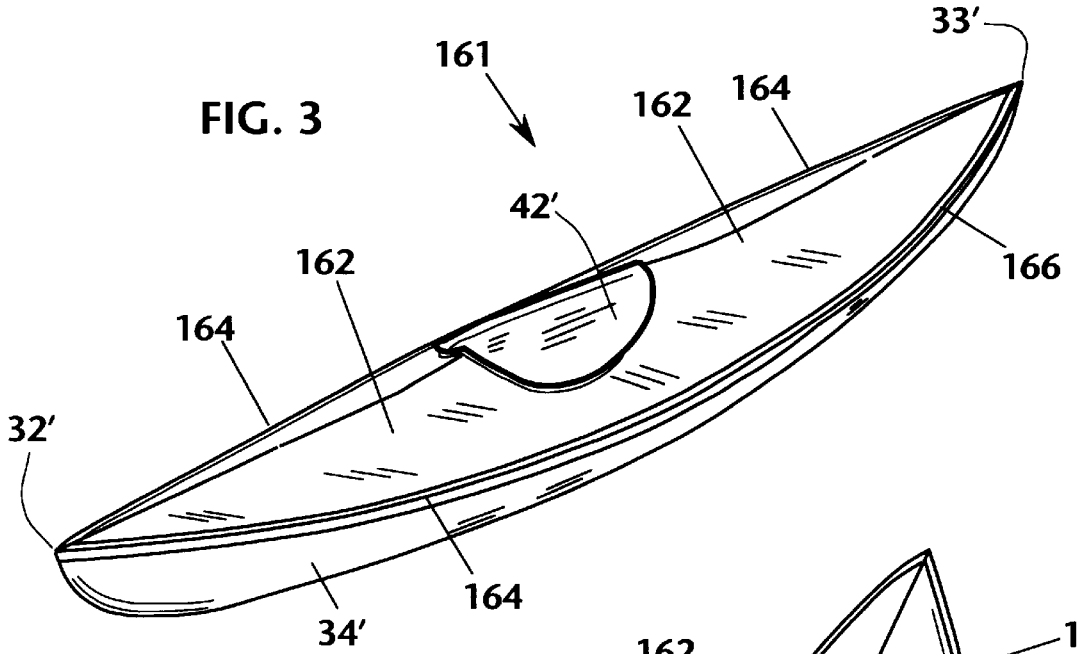
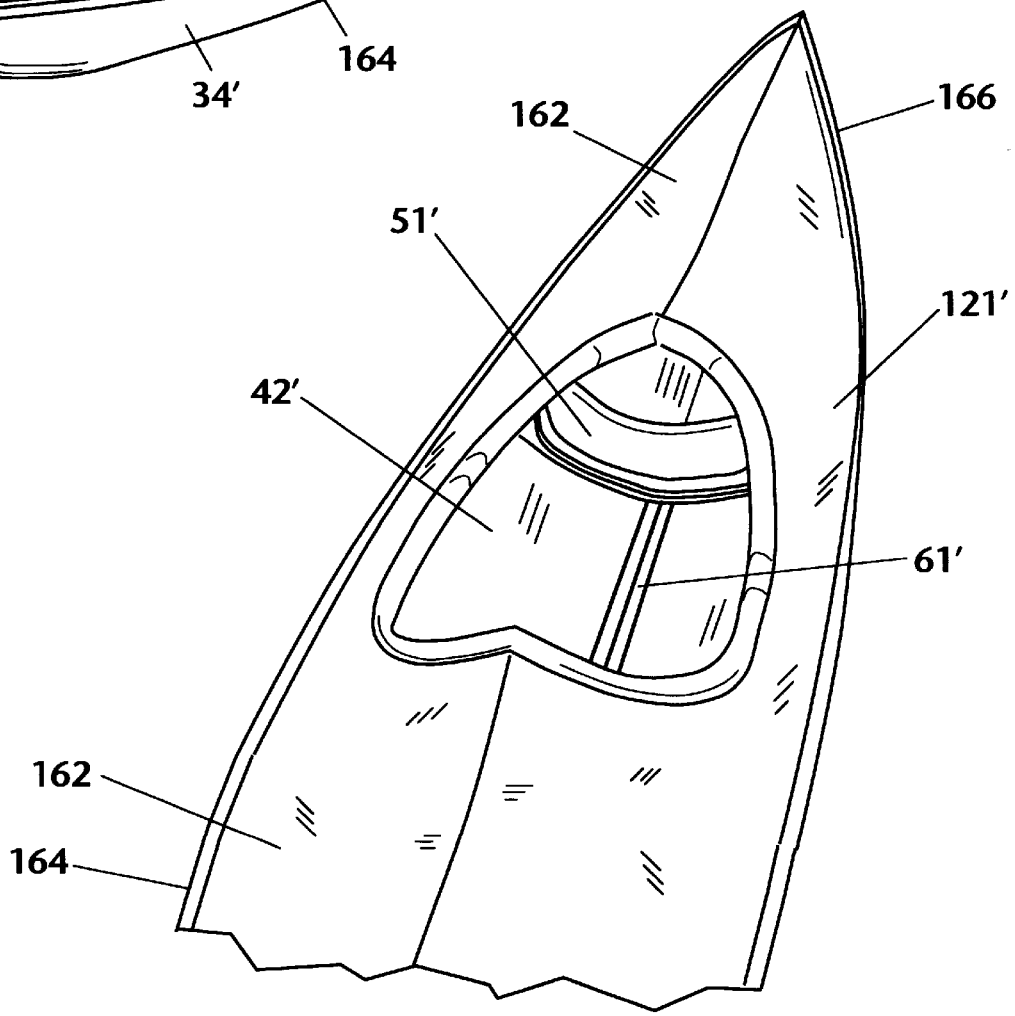
FIG. 4

KNOCK-DOWN BOAT ASSEMBLY

BACKGROUND OF THE INVENTION

The present invention relates to knock-down boat structures, and more particularly to an assemblable boat formed of roll-up panel elements and associated structural components.

High performance, lightweight personal watercraft have enjoyed a renaissance in recent years, primarily due to the advent of kayaks for white water use, as well as river and ocean-going kayaks. In addition, small personal boats continue to be used for hunting and fishing, as well as wilderness travel on waterways and lakes. Although such watercraft are well designed for use on water, they are often difficult to transport by vehicle, due to their size factors, particularly length.

As a result, there is a strong need and desire for watercraft that can be reiteratively disassembled for transport in small packages and reassembled for use in the field. The simplest of such boats are inflatables, which rely on pneumatic tubes not only to create positive buoyancy, but also to provide rigidity, structural shape, and resistance to impact with obstacles. However, inflatables are generally low performance craft, due to the shape limitations imposed by the pneumatic tubes. Moreover, pressure loss can be catastrophic, even with the provision of compartmentalized pneumatic chambers.

Another class of knock-down watercraft is the folding boat, which is generally comprised of an expandable internal frame that supports a removable flexible outer skin defining the hull and deck. Often the outer skin is a durable waterproof fabric stretched taut over the internal frame to define a streamlined shape that is more efficient than most inflatable craft. One problem associated with this construction is that assembly of the complex frame structure can be a difficult process.

Another common problem involves the assembly of separate panels to form the outer skin. If the panels are joined permanently, and folded along the joining seam, there is a concentration of wear and stress along the seam that can result in leaks and structural failure. This difficulty may be exacerbated if the folded panel construction is then rolled or folded across the joining seam. On the other hand, if the panels are joined temporarily and designed to be separable, it is necessary to provide a mechanism for joining the panels along generally long seams that is reliable and reusable. Moreover, the mechanism must provide both a waterproof seal and a strong mechanical bond, as the boat relies on tension in the outer skin to define the hull shape. In the prior art, waterproof zippers used for this purpose have been the locus of minor failures such as leakage and major failures such as catastrophic separation of the panels.

Regarding the panels that define the hull and deck of the watercraft, every design requires a compromise between providing a frame that minimizes unsupported spans of the outer skin, and providing a hull material that is sufficiently stiff to maintain its shape yet sufficiently flexible for folding. A more extensive frame involves added weight and complexity in assembly, whereas heavier hull materials are more difficult to fold and limit the compactness of the knock-down state of the watercraft. A possible solution to this design dilemma is to provide removable stiffeners or stays to strengthen the hull panels, as long as these components do not add to the difficulty in boat assembly.

SUMMARY OF THE PRESENT INVENTION

The present invention generally comprises an improved folding boat assembly that embodies a combination of technological innovations to define a watercraft that is light, sturdy, easy to assemble and disassemble, and collapsible into a small package.

One major component of the folding boat assembly comprises a hull formed of a pair of flexible panels extending longitudinally and joined along a longitudinal common edge. A flexible hinge extends longitudinally at the common edge to join the two hull panels The hinge permits the hull panels to be rolled into a storage configuration or deployed in an expanded use disposition. In the expanded disposition, the hull panels are arranged to form a V-shaped configuration, the apex of the V coinciding with the common longitudinal edge of the panels and with the keel line of the hull. To store the hull panels, the panels may be disposed in generally planar, abutting relationship, and rolled about an axis that is parallel to the plane of the panels and generally orthogonal to the longitudinal common axis. Alternatively, the hull panels may be folded in accordion fashion using a plurality of S-shaped folds. The hull panels may be formed of a coated fabric, or a web of waterproof material, or a thin, flexible polymer or plastic material such as ABS thermoplastic.

To impart strength and stiffness to portions of the hull panel, the invention further provides removable panel stiffener assemblies. One form of the panel stiffener includes a flexible extruded runner secured to the interior surface of the hull panel and provided with an interior channel formed therein. The runner is designed to be sufficiently flexible to permit folding of the panel for storage. A substantially rigid rod, stay, or the like is dimensioned and configured to be slidably inserted in the channel of the runner to impart stiffness thereto in the expanded disposition of the hull panels.

In another form of the panel stiffener assembly, a plurality of pairs of bracket pads are secured to the interior surface of the panel in a linearly extending array. A stiffener beam, such as an I beam or the like, is provided with opposed flanges that may be slidably engaged into the linear array of paired brackets, thereby imparting substantial strength and stiffness to the otherwise flexible hull panels. The bracket pads may be formed of the same material as the hull panel itself, or any material that bonds well to the hull panel. If the stiffener assemblies are disposed on confronting interior surface portions of the paired hull panels, the linear arrays are staggered so that the bracket pads interdigitate when the hull panels are disposed in the collapsed, rolled configuration.

An alternative form of panel stiffener assembly includes a plurality of pairs of bracket pads are secured to the exterior surface of the panel in a linearly extending array. An external stiffener beam is provided with flanged edges to engage the bracket pads in slidable fashion, so that the stiffener beam may be installed and removed with ease. The external stiffener beam further includes a curved outer fairing extending longitudinally and disposed to define a smooth hydrodynamic shape. The opposed edges of the fairing may extend to contact the exterior surface of the hull panel to reduce intrusion of sand and grit that may otherwise interfere with removal of the external stiffener beam. In general, a variety of internal or external removable stiffeners may be used in combination with permanent stiffeners of any type to define bending and non-bending zones in the structure.

Another aspect of the invention is the provision of an internal frame that includes a pair of folding, cam-action frame assemblies adapted to support the hull panels in the expanded disposition, as well as other portions of the watercraft. Each cam-action frame assembly includes a pair of frame structures, each including an upper leg and a lower leg extending from a common vertex. The distal ends of the lower legs are joined by a hinge pin to form a conjoint rotating assembly, so that the assembly is rotatable from an open configuration in which the distal ends of the upper legs diverge widely to a closed configuration in which the distal ends of the upper legs are abutting.

Each common vertex of each frame structure is provided with a clip adapted to engage a frame-engaging bracket installed on a gunwale edge of a medial portion of the hull assembly. With the hull panels disposed in the expanded, V-shaped configuration and each frame structure rotated to an open disposition, the clips of each frame structure are secured to the respective frame-engaging brackets of the opposed hull panels. The upper leg portions of the frame assemblies are then manually urged together, exerting a leveraged, cam-action tension on the hull panels that pulls the hull panels taut against the lower leg portions of the frame assemblies. The abutting ends of the upper legs may be releasably secured by any common form of latch. The lower leg portions of the frame assemblies may be curved, thus defining the transverse section curvature of the medial portion of the hull. Panel stiffeners may be extended along the keel line between the cam action frame assemblies to support compression forces therebetween.

The frame structure further includes a cockpit coaming that spans the gunwales and extends over the cam-action frame assemblies, The cockpit coaming comprises a pair of panels hinged together along the coaming midline, with a pair of C-shaped openings, one in each panel, that together define the cockpit opening for the passenger. Each panel includes a longitudinal compression column joined to shear web portions at opposed ends of each panel. The coaming may be folded along the hinge line for storage and transport, and opened to be deployed across the gunwales. A pair of transverse cockpit strap assemblies secures the coaming to the hull assembly.

The internal frame further includes a pair of deck support assemblies, each consisting of a longitudinal tube adapted to be received in a fitting secured to the cockpit coaming along the midline thereof. A bow end plate with a curved forward edge is secured to the forward deck support tube, the curved edge fitting in complementary fashion in the prow portion of the junction of the hull panels. The aft deck support tube is likewise secured to a stern end plate that defines the curvature of the stern portion of the junction of the hull panels. Thus compression forces applied between the bow and stern are transferred through the deck support tubes to the cockpit coaming, and through the shear webs of the cockpit coaming to the compression columns thereof.

A pair of vertical columns are also provided, each extending between a medial portion of one of the deck support tubes and the keel line of the hull assembly. The vertical columns enable the deck support tubes to maintain proper deck shape and height. A pair of hull spreader struts are secured to respective vertical columns to maintain proper spacing of the hull panels both forward and aft of the cam-action frame assemblies.

A further aspect of the folding boat assembly is the provision of a deck that extends from bow to stern and across the gunwales, except for the cockpit area, to prevent entry of water into the interior of the craft. In one embodiment a fabric deck is formed as a deck panel extending fore and aft and secured permanently to the respective fore and aft gunwale edges of the hull panels. The deck panel includes a pair of sealable openings, extending along the midline from a medial edge of the deck panel toward the distal end (bow or stem) thereof. The sealable openings, which are provided with sealable fastening means to join confronting edges of the openings in leakproof fashion, enable the installation and removal of the deck support tubes and vertical columns, as well as providing space for placement of the cam-action frame assemblies.

Alternatively, the deck may be formed by a panel deck assembly, comprising a deck panel removably secured to the hull assembly. The deck panel is joined to the hull assembly by sealable fastening means that extend along the gunwale edges of the hull assembly in continuous fashion from the bow to stem. The deck panel may be formed of a material similar in composition and physical characteristics to the hull panels, and may be rolled into a storage package in combination with the hull panels.

In either deck embodiment, the sealable fastener means comprises a waterproof zipper constructed in accordance with one of several embodiments of the invention. For the panel deck assembly, one zipper embodiment includes one zipper welt secured to the deck panel, the zipper welt including an integral groove that is disposed to receive the gunwale edge of the adjacent hull panel. The other zipper welt is secured adjacent to the gunwale edge of the hull panel. As the zipper welts are joined by the zipper slider, the gunwale edge is urged into the integral groove in a sealing relationship. The zipper thus forms a mechanical bond between the deck panels and the hull panels, and also forms a waterproof junction that excludes water entry from the interior of the boat.

A further embodiment of the waterproof zipper is adapted for the sealable opening of the fabric deck, described above. This embodiment includes a pair of seal welts, each secured to an opposed edge of the sealable opening. The seal welts include confronting longitudinal channel portions that may be brought into impingement with a longitudinally extending seal entrained in the joined channel portions. Each seal welt supports a pair of conventional zipper teeth arrays disposed above and below the seal, and a pair of conventional zipper sliders engage these two zipper teeth arrays. In addition, a main zipper car engages grooves formed in the outer edges of the seal welts. The main zipper car resembles a larger version of a common zipper slider. It brings the left and right seal welts together with a squeezing action ahead of the paired conventional zipper sliders to facilitate ease of opening and closing of the assembly. The main zipper car is joined to the toggle members of the conventional zipper sliders by a blade-like actuating pin extending therethrough.

The components of the invention may be employed to construct knockdown boat structures that are assembled and disassembled as desired, or may be used to form kit boats that are assembled once and remain in the erected, usable state thereafter.

The various innovations embodied in the folding boat of the invention are considered as well to be separate inventions that are applicable to a wide range of uses. For example, the roll-up panels of the hull and deck may be applied to constructing structures, knock-down buildings, aircraft, and the like. The cam-action frame assemblies may be applied to aircraft, wheeled vehicles, tent constructions, and the like. The waterproof zipper embodiments may be applied to dry storage bags, knock-down building constructions, kit structures, automotive uses, and the like.

BRIEF DESCRIPTION OF THE DRAWING

FIG. 3 is a perspective view of an alternative embodiment of the folding boat.

FIG. 4 is an enlarged, partial perspective view of the folding boat of FIG. 3, showing a portion of the interior of the boat through the cockpit.

DESCRIPTION OF THE PREFERRED EMBODIMENT

Figure 1:
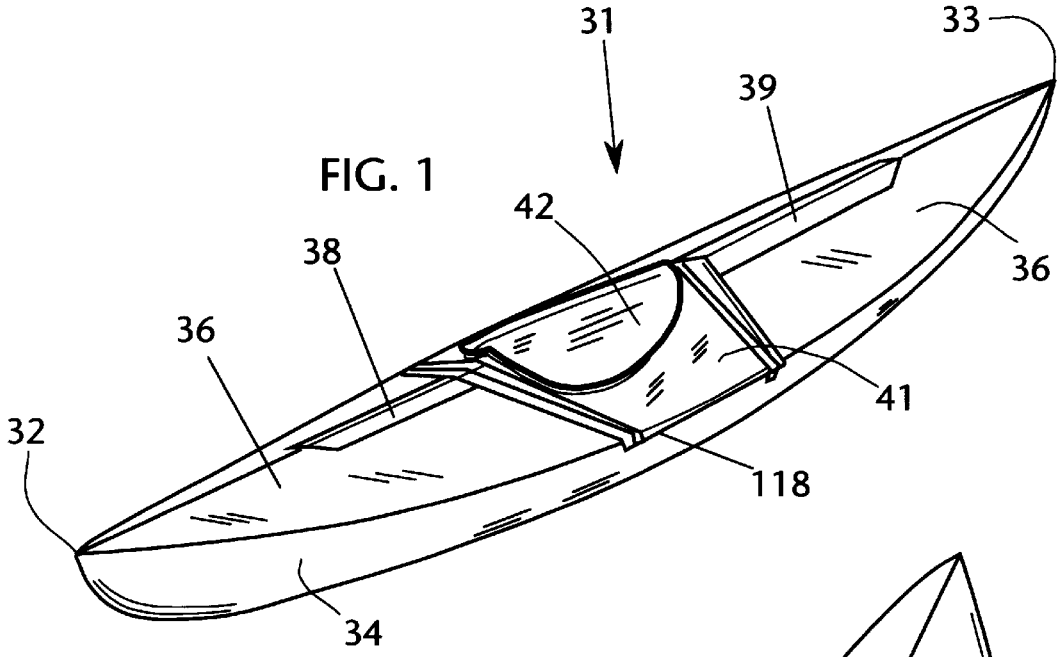
FIG. 1 is a perspective view of the folding boat constructed in accordance with the present invention.

The present invention generally comprises an improved folding boat assembly that embodies a combination of technological innovations to define a watercraft that is light, sturdy, easy to assemble and disassemble, and collapsible into a small package. With regard to FIGS. 1 and 2, one embodiment of the invention (shown in the assembled disposition) comprises a kayak-like watercraft 31 having a bow 32 and a stem 33. A V-shaped hull assembly 34 extends continuously from bow to stern. A deck assembly 36 extends continuously across the forward and aft gunwales to enclose the fore and aft portions of the craft in watertight fashion. In this embodiment the deck assembly is permanently joined to the hull assembly, and deck zippers 38 and 39 are provided to seal deck openings that permit assembly and separation of the internal components of the boat, as described in the following specification. A removable cockpit coaming 41 spans the gunwales amidship, and defines a cockpit 42 dimensioned to receive a passenger.

Figure 14:
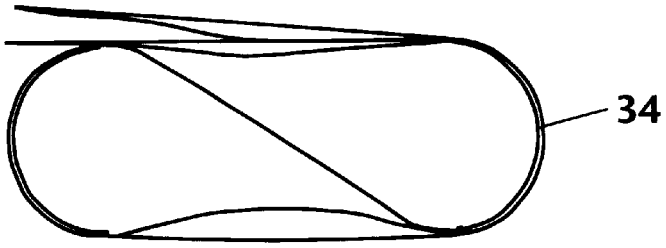
FIG. 14 is a diagrammatic end view showing one format for rolling the flexible panels that comprise the hull and deck of the folding boat.
Figure 15A:
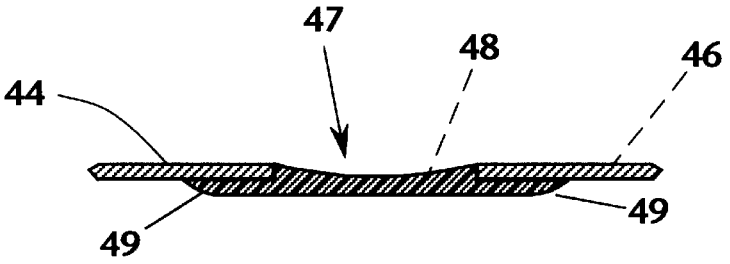
FIG. 15A, 15B, and 15C are cross-sectional end views of the panel hinge member joining the two bilateral hull panels of the folding boat, shown in completely open, V-fold, and completely folded dispositions, respectively.
Figure 15B:
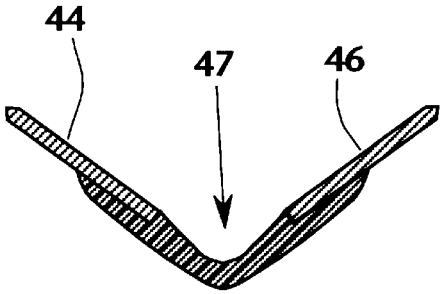
Figure 15C:
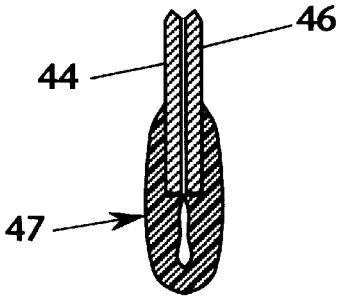

The hull assembly 34 is comprised of a pair of identical flexible panels 44 and 46 extending longitudinally from bow to stern. The panels 44 and 46 may be formed of a high strength coated fabric, or a sheet of waterproof material, or preferably a thin, flexible polymer or plastic material such as ABS thermoplastic. The material is chosen for strength and a combination of form-retaining stiffness and sufficient flexibility to permit folding or rolling the panels in a radius of curvature of several inches to a foot, as shown in FIG. 14. The hull assembly further includes a flexible hinge 47 extending longitudinally from bow to stem and joined to confronting longitudinal edges of the hull panels 44 and 46, as shown in FIG. 15A. The material that forms the hinge 47 is chosen for strength and flexibility, and may comprise a high strength rubber capable of withstanding repeated wetting and drying and exposure to the elements, such as Hypalon™ rubber, or a durable polymer such as chlorsulfonated polyethylene. The hinge 47 includes laterally opposed side portions 49 adapted to be bonded to the longitudinal edges of the hull panels. The hinge 47 further includes a central portion 48 capable of bending and folding along its longitudinal axis to an extent permitting the hull panels 44 and 46 to be laid flat in a common plane, as shown in FIG. 15A, or deployed in a V-shaped disposition for assembly of the watercraft (FIG. 15B), or folded together into confronting relationship at a common plane for storage (FIG. 15C). The hinge 47 is further capable of bending transversely with respect to the longitudinal fold to permit folding or rolling of the hull assembly, as shown in FIG. 14.

The invention further includes removable internal structural components to support the hull assembly in its deployed configuration, so that the hull will displace water, resist wave action, and withstand impact with objects. With reference to FIGS. 5–8, a major internal structural feature is a pair of folding, cam-action frames 51 disposed directly fore and aft of the cockpit 42. The frames 51 provide a structure that is rigid in lateral and vertical extents to define the beam dimension of the boat and to support the fore and aft edges of the cockpit coaming 41. Moreover, the cam action operation of the frames 51 provide a means for stretching the hull panels about the frames 51 and placing the hull assembly under tension in a convex curved disposition, thereby increasing its strength and ability to displace water.

Each frame 51 includes a pair of identical side components 52. Each side component 52 is formed with the cross-section of a structural I-beam, and includes an upper leg 53 and a lower leg 54 joined at a common vertex. In the embodiment depicted, the upper leg 53 is generally linear and the lower leg 54 is a convex curve, but these configurations are not limiting. The distal ends of the legs 54 of the paired components 52 are joined by a hinge pin 57 to form a conjoint rotating assembly. The assembly is rotatable from an open configuration (FIG. 7) in which the distal ends of the legs 53 diverge widely, to an closed configuration in which the distal ends of the legs 53 are abutting. If necessary, a releasable latch 58 may be provided to join the confronting ends of the legs 53.

Secured to each vertex 56 of each side component 52 is a clip 62 including a tang extending therefrom. A plurality of brackets 61 are secured to the gunwale 63 of each hull panel 44 and 46, each bracket positioned to engage and retain the tang of one of the clips 62 under tension. Thus, the frames 51 may be disposed between the hull panels 44 and 46 during erection of the boat, with the hull panels diverging widely and the frames in the open disposition, as in FIG. 7. The clips 62 are engaged in their respective brackets 61 to join the hull assembly to the frames 51, and each frame is then rotated to the closed disposition of FIG. 8, and latched. The cam action closure of each frame 51 creates a mechanical advantage that applies tension to the hull assembly from gunwale to opposed gunwale, stretching the hull assembly about the curved lower legs 54 of the frame 51 and establishing a smooth curved hull conformation. The frames 51 thus provide not only great structural strength to the watercraft, but also provide an easy means for erecting the hull assembly under tension without resorting to undue manual effort or to external aids.

When the flat hull panels 44 and 46 are deformed in a complex three-dimensional shape in the assembled boat, compressional stresses are developed in the hull panels which may cause buckling in some portions thereof, especially in the medial area of the bottom of the hull assembly. Conventional stiffening by addition of permanent stringers, doubled panel thickness or other permanent structural elements cannot be used, due to the requirement of folding and rolling the hull panels for knockdown storage and transport.

To counteract the compressive buckling stresses developed in the hull assembly, the invention provides removable panel stiffener assemblies. Thus removable panel stiffener assemblies 61 (FIGS. 5 and 6) may be secured to the hull panels in the bottom of the craft 31 between the lower portions of the cam-action frames 51. In addition, removable panel stiffener assemblies may be secured in forward portions of the hull panels to provide enhanced impact resistance, or along chordal sections of the hull assembly, or the like.

Figure 10:
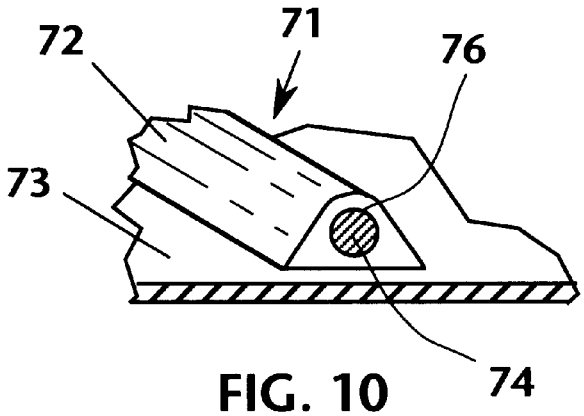
FIG. 10 is a cutaway perspective view of one embodiment of a removable, internal panel stiffener assembly for stiffening the hull panels of the folding boat.

As shown in FIG. 10, one embodiment of the removable panel stiffener 71 comprises a flexible extruded welt 72 extending along an axis and secured permanently to a panel 73. The welt 72 includes an internal bore 76 extending along the axis of the welt 72 and dimensioned to receive an internal rigid stiffener member 74 therein in slidable, removable fashion. The welt 72 itself does not add significant stiffness to the panel 73, permitting the panel to be rolled or folded as required for disassembly of the boat. However, the addition of the stiffener 74 in the bore 66 adds substantial stiffness and compression strength to the panel 73. The welt may be formed of an extruded polymer material, and the stiffener 74 may comprise a metal, polymer, or fiber reinforced polymer material.

Figure 11:
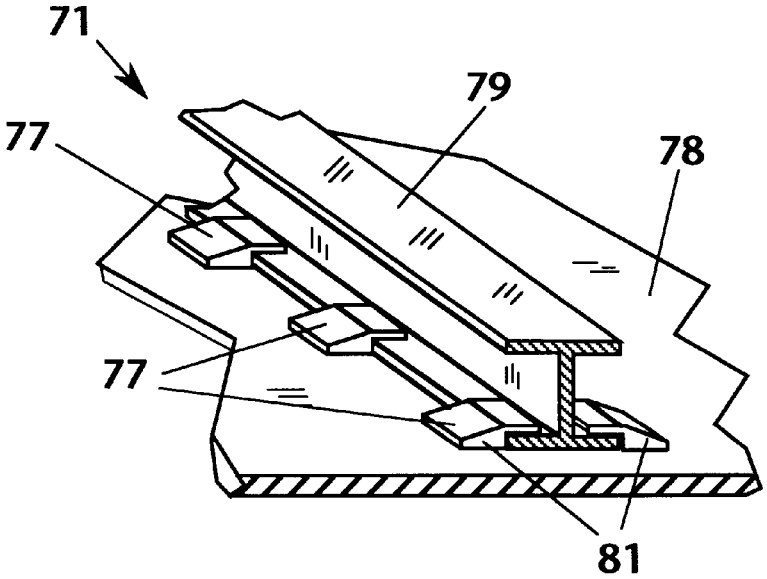
FIG. 11 is a cutaway perspective of a further embodiment of a removable, internal panel stiffener assembly for stiffening the hull panels of the folding boat.

With reference to FIG. 11, a further embodiment of the stiffener assembly 71 may comprise a plurality of brackets 77 bonded to a panel 78. The brackets and the panel both may be formed of ABS thermoplastic to assure a high strength bond. The brackets 77 are arrayed in pairs 81 and adapted to capture therebetween one side of an I-beam stiffener member 79 in slidable, removable fashion. The pairs 81 are disposed in a linear array, whereby the stiffener 79 may be slidably engaged in the paired brackets and removably joined to the panel. The brackets are sufficiently small so that they do not contribute any significant stiffness to the panel 78, but the I-beam stiffener 79 adds great stiffness and compressive strength.

When stiffener assemblies are secured to opposed hull panels in enantiomorphic fashion, it may be advisable to dispose the linear arrays of paired brackets 81 in staggered fashion, so that when the panels are folded into intimate contact (the stiffener members being removed) the brackets 77 of the opposed linear arrays will interdigitate to form a collapsed package of minimum height.

It may be desirable or necessary to place removable stiffener assemblies on the exterior surface of the hull panels. With regard to FIG. 12 a plurality of brackets 77 may be arrayed in a linear array of pairs 81, as described with respect to FIG. 11, except that the brackets are bonded to the exterior surface of a panel 82. An external removable panel stiffener member 87 is provided, the member 87 including a longitudinally extending web 83 adapted to be slidably engaged by the pairs 81 of brackets 77. An external longitudinally extending web 86 is joined by an orthogonal web 84 to the member 83, the web 86 having a convex curvature that provides a faired, streamlined profile to the passing water flow. The curvature of member 86 also reduces intrusion of sand and grit that can hamper removal of the stiffener member 87, while providing added stiffness in combination with the webs 83 and 84.

Figure 12:
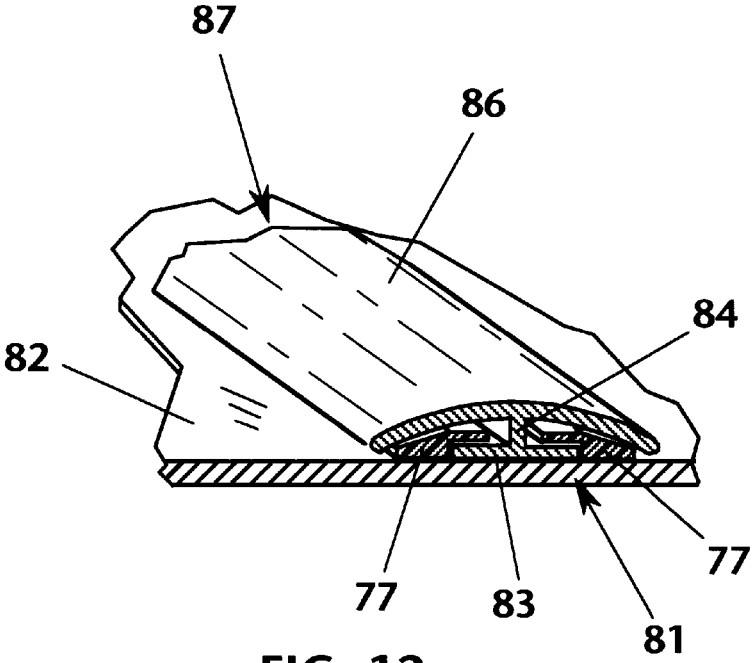
FIG. 12 is a cutaway perspective of one embodiment of a removable, external panel stiffener assembly for stiffening the hull panels of the folding boat.
Figure 13:
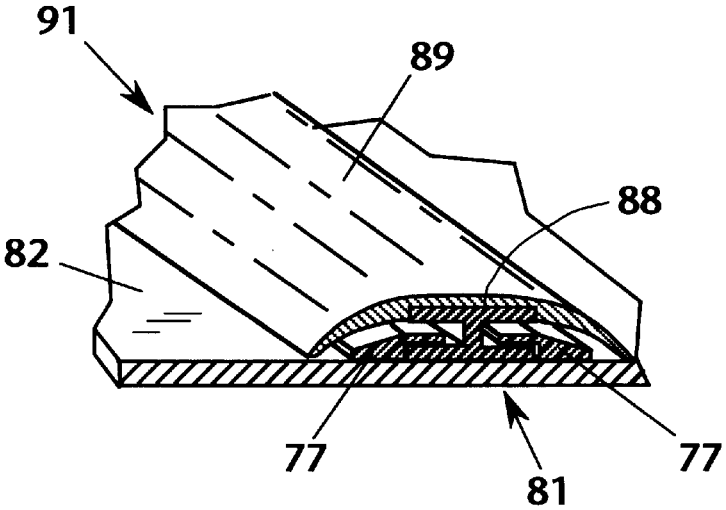
FIG. 13 is a cutaway perspective of a further embodiment of a removable, external panel stiffener assembly for stiffening the hull panels of the folding boat.

A further embodiment of an external removable panel stiffener 91, shown in FIG. 13, combines some aspects of the stiffeners described in FIGS. 11 and 12. The brackets 77 are disposed in pairs 81 and aligned in a linear array on the exterior of a panel 82, and an I-beam stiffener member 88 is received in removable slidable fashion in the brackets 77, as described previously. In addition, an external fairing 89 is secured to the member 88 coextensively therewith, the fairing providing all of the characteristics noted with respect to the embodiment of FIG. 12.

Figure 5:
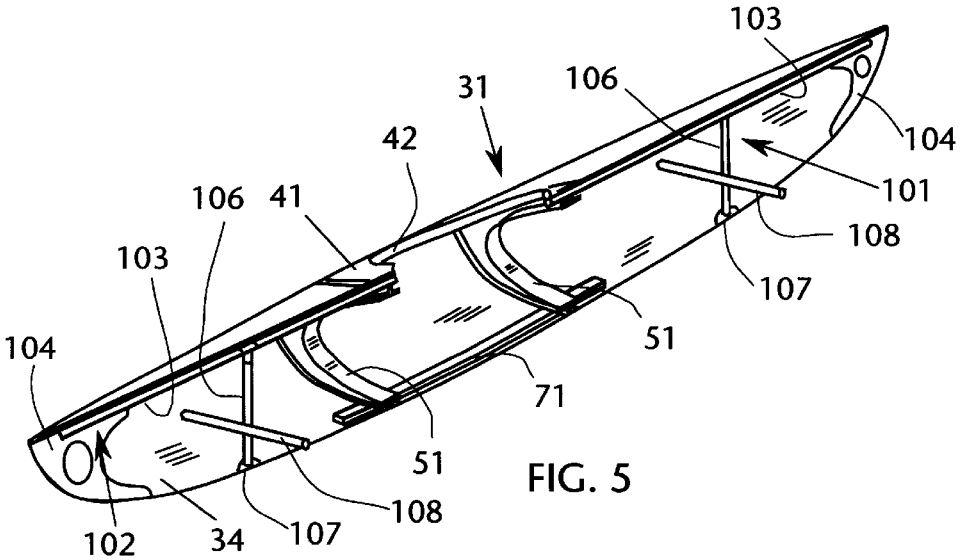
FIG. 5 is a cutaway perspective view of the folding boat of the invention, showing the internal supporting framework.
Figure 6:
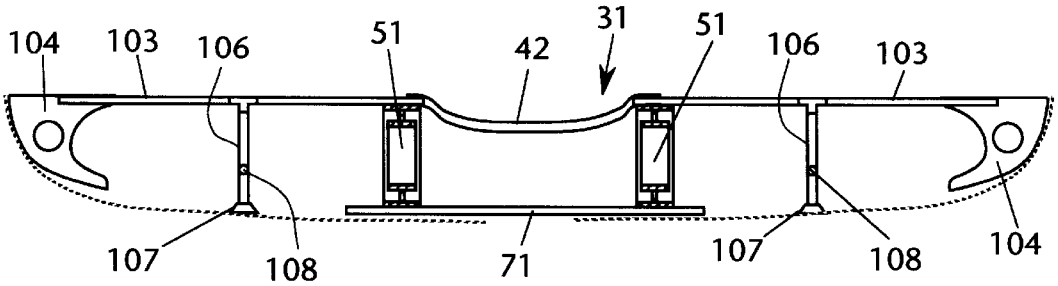
FIG. 6 is a side elevation of the internal supporting framework shown in FIG. 5.
Figure 7:
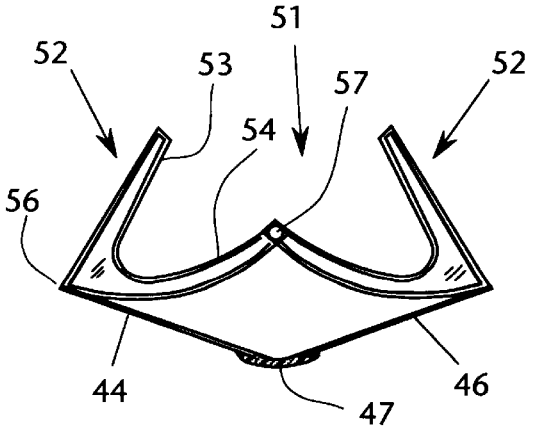
FIG. 7 is an end view of the folding, cam-action frame assembly of the invention, joined to the flexible hull panel assembly and disposed in the open configuration.
Figure 8:
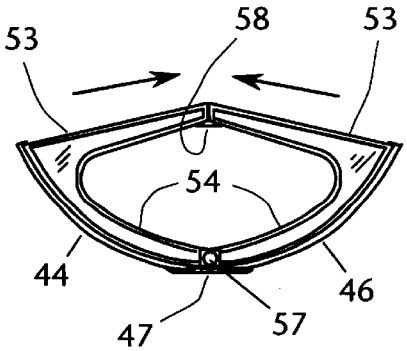
FIG. 8 is an end view of the folding, cam-action frame assembly as in FIG. 7, shown in the closed, erected configuration.
Figure 9:
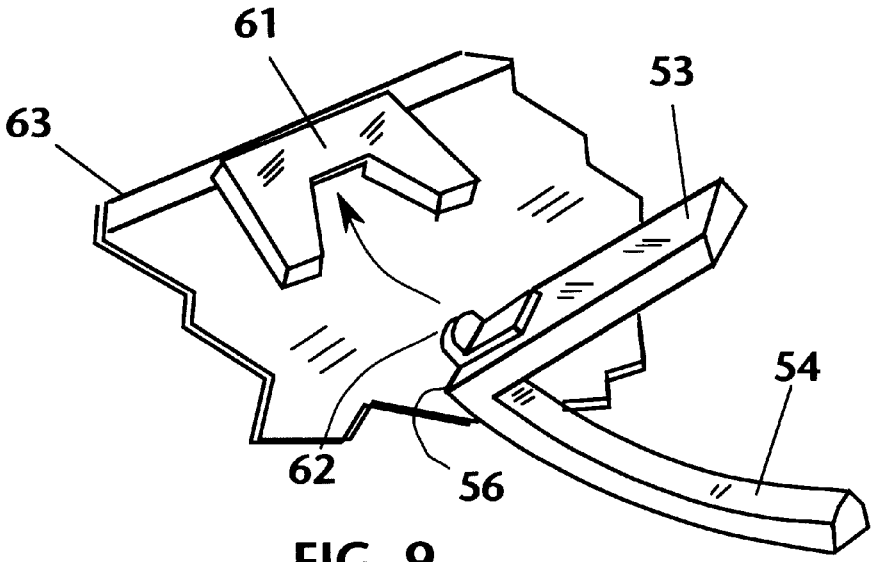
FIG. 9 is a perspective view of the clip fastener assembly for joining the hull panels to the folding, cam-action frame assembly.

With regard to FIGS. 5 and 6, the internal structure of the boat further includes a pair of deck support assemblies 101 and 102, which are substantially similar in construction. Each deck support assembly includes a longitudinal strut 103 having an outer end secured to an end plate 104. Each end plate 104 includes a curved outer margin that fits in complementary fashion to the prow or stern portion of the hull assembly 34. Each deck support assembly also includes a vertical support column 106 extending between a medial portion of the longitudinal strut 103 and the keel line of the hull assembly 34. The lower end of each vertical column includes a foot 107 to distribute any load laterally and longitudinally in the hull assembly. A hull spreader strut may optionally be provided, secured to each vertical support column to maintain proper spacing and curvature of the hull panels 44 and 46 both fore and aft of the cam-action frame assemblies 51.

The longitudinal struts 103 are provided to accommodate longitudinal compressive loading between the bow and stern, and to transfer these longitudinal forces to the cockpit coaming, as will be explained in the following description. The vertical columns 106 permit the longitudinal struts also to support vertical loading on the deck 36, enabling the deck to maintain its longitudinal ridge and to shed water. The vertical columns 106 also enable the keel line of the hull assembly 34 to maintain its designed conformation.

Figure 16:
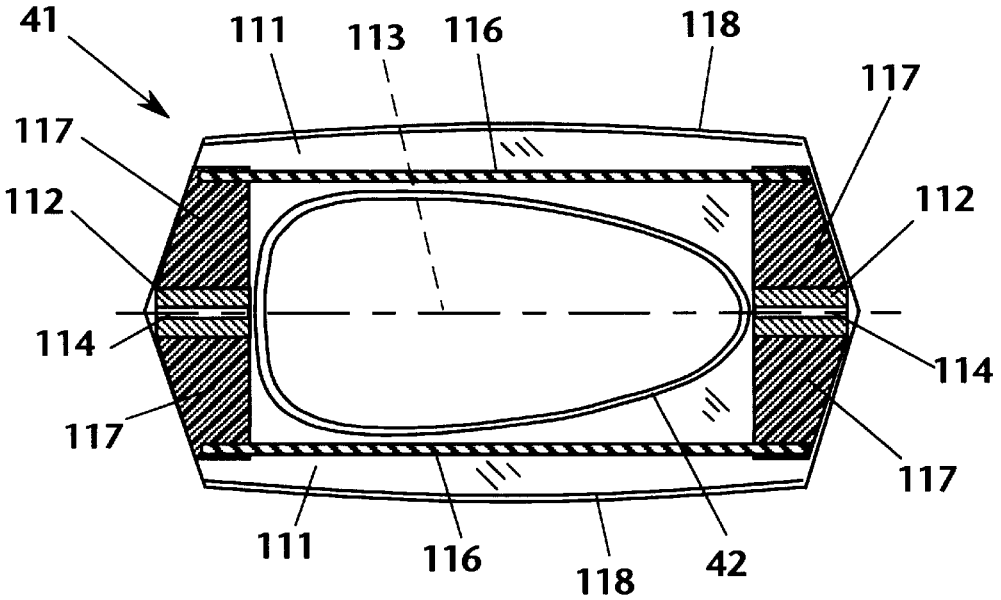
FIG. 16 is a partially cutaway top view of the cockpit coaming assembly of the folding boat.

With regard to FIG. 16, the cockpit coaming 41 is comprised of a pair of panels 111 configured in enantiomorphic fashion and joined by a pair of hinges aligned along an axis 113. Each panel 111 includes a C-shaped opening 114, the two openings 114 being disposed in confronting relationship to define the cockpit opening 42 depicted in FIGS. 1 and 2 and elsewhere. The two panels 11 1 are foldable along the axis 113 from a storage position in which the two panels are abutting, to a deployed disposition in which the two panels diverge from the axis 113 at an oblique angle. The axis 113 is aligned generally with the longitudinal axis of the boat 31.

The coaming 41 includes a pair of socket fittings 114 disposed at axially opposed ends of the coaming, each adapted to receive the inner end of one of the longitudinal struts 103 in removable fashion. Each panel 111 further includes a compression column 116 extending longitudinally therein the length of the panel. A shear web 117 extends laterally in each end of each panel from each socket fitting 114 to the respective compression column 116. The shear webs 117 and compression columns 116 may comprise reinforced portions that are molded integrally into the panels 111, or may comprise separate components joined to the panels 111.

Turning to FIGS. 5 and 6 again, the longitudinal compressive loads exerted on the bow and stern are transferred through the struts 103 to the cockpit coaming 41. The shear webs 117 transfer these loads to the compression columns 116, whereby a rigid structure is defined for carrying the longitudinal compressive forces around the cockpit opening and the passenger therein.

Figure 2:
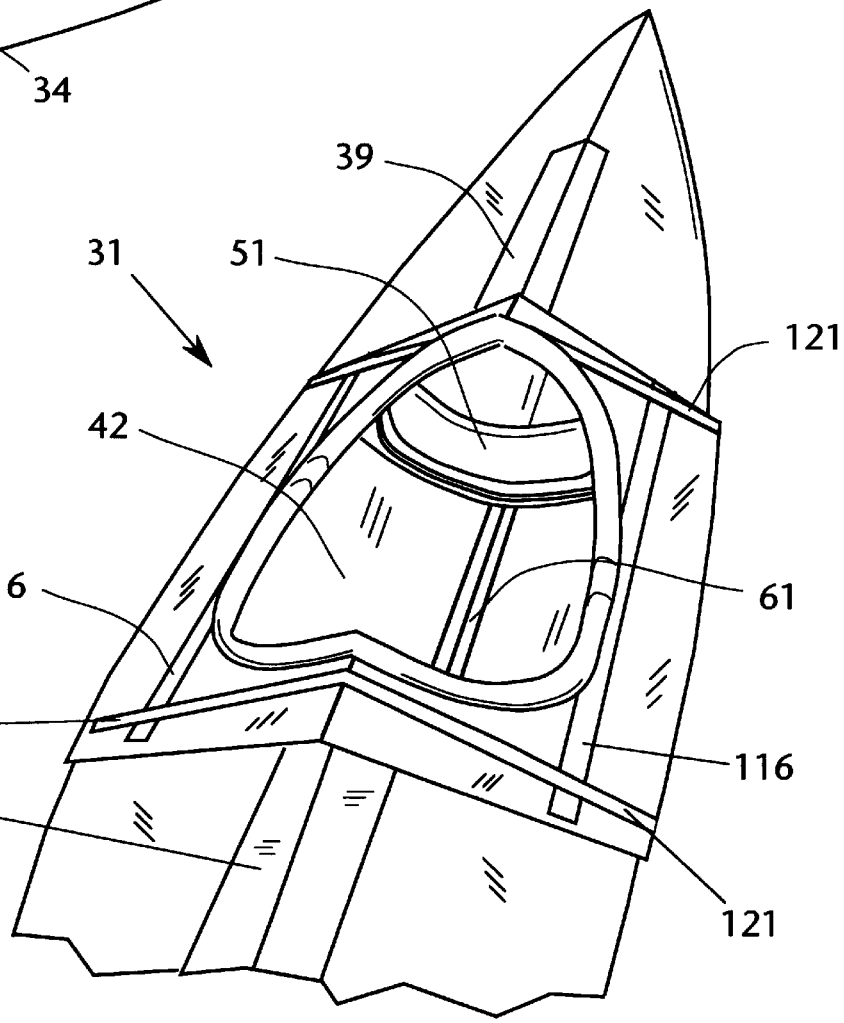
FIG. 2 is an enlarged, partial perspective view of the folding boat of FIG. 1, showing a portion of the interior of the boat through the cockpit.

The cockpit coaming 41 is sufficiently long to span the distance between the two cam-action frame assemblies 51, the assemblies 51 providing vertical support for the opposed ends of the coaming 41. The deployed width of the coaming 41 is sufficient to permit the outer flanged edges 118 of the panels 111 to overhang the medial portion of the gunwales of the hull assembly, as shown in FIGS. 1 and 2. A pair of strap assemblies 121 are secured to opposed medial portions of the hull assembly, and adapted to extend over the longitudinally opposed ends of the cockpit coaming 41 to tie the ends down onto the frame assemblies 51 with the deck panel 36 sandwiched therebetween.

As noted previously, deck zippers 38 and 39 are provided to seal openings in the fore and aft portions of deck 36 that permit assembly and separation of the internal components of the boat, such as the frame assemblies 51, the longitudinal struts 103, the vertical columns 106, the hull spreaders 108, and the bow and stem plates 104. The deck zippers must be able to withstand shear stress and tension while remaining waterproof and leakproof to a very high degree.

Figure 19:
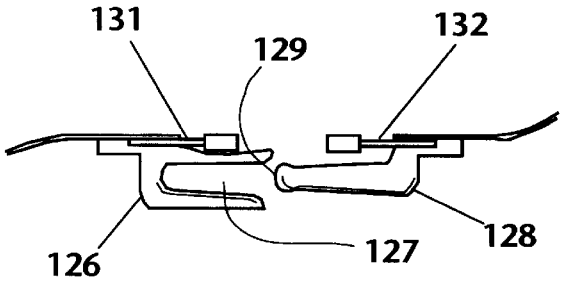
FIG. 19 is a cross-sectional end view of a further embodiment of a sealed deck zipper, shown in an open configuration.
Figure 20:
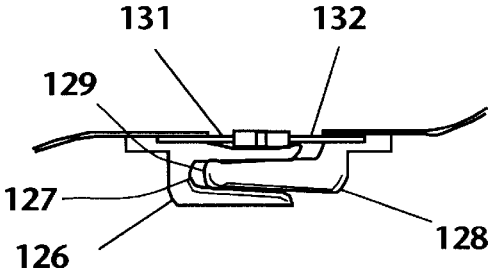
FIG. 20 is a cross-sectional end view of the sealed deck zipper of FIG. 19, shown in the closed configuration.
Figure 21:
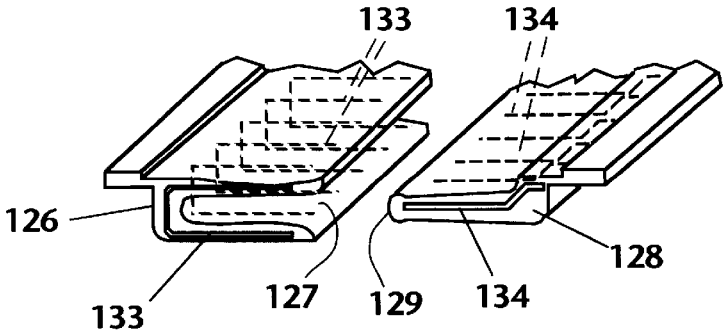
FIG. 21 is a perspective end view of the sealed deck zipper of FIGS. 19 and 20.

With regard to FIGS. 19–21, one embodiment of the deck zippers 38 and 39 includes a seal welt 126 disposed longitudinally and including a channel 127 extending the length thereof. Another seal welt 128 is disposed longitudinally and includes a protruding rib 129 extending the length thereof. The welts are joined to respective opposed sides of the deck openings. The welts are dimensioned so that the rib 129 is slightly larger that the opening of the channel 127, and the channel 127 is formed of a resilient material that is elastically deformable by insertion of the rib 129 therein. One side 131 of a conventional zipper is secured to the welt 126, and the other side 132 of the zipper is secured to the welt 128. By urging the rib 129 into the channel 127 while the zipper slider car is advanced to join the zipper sides 131 and 132, the welts 126 and 128 may be joined in sealed fashion, as shown in FIG. 20. The zipper provides the mechanical strength for the assembly, and the welts 126 and 128 provide the leakproof seal required for the deck zippers.

It is important to control the stiffness of the channel 127 and rib 129, so that these components are sufficiently rigid to provide self-alignment without being so stiff that the rib cannot be separated from the channel. To provide the proper rigidity, a plurality of C-shaped reinforcing elements 133 may be spaced apart longitudinally and embedded in the welt 126, the legs of the reinforcing elements extending to opposed sides of the channel 127. Likewise, a plurality of dogleg shaped reinforcing elements 134 are spaced apart longitudinally and embedded in the rib 129. The reinforcing elements 133 and 134 may comprise fiber bundles, stiff wires of metal or plastic, or the like. The welts 126 and 128 may be formed of any suitable rubber, plastic, or polymer material that has the proper characteristics of elasticity, rigidity, lubricity, and tolerance for repeated wetting and drying.

Figure 22:
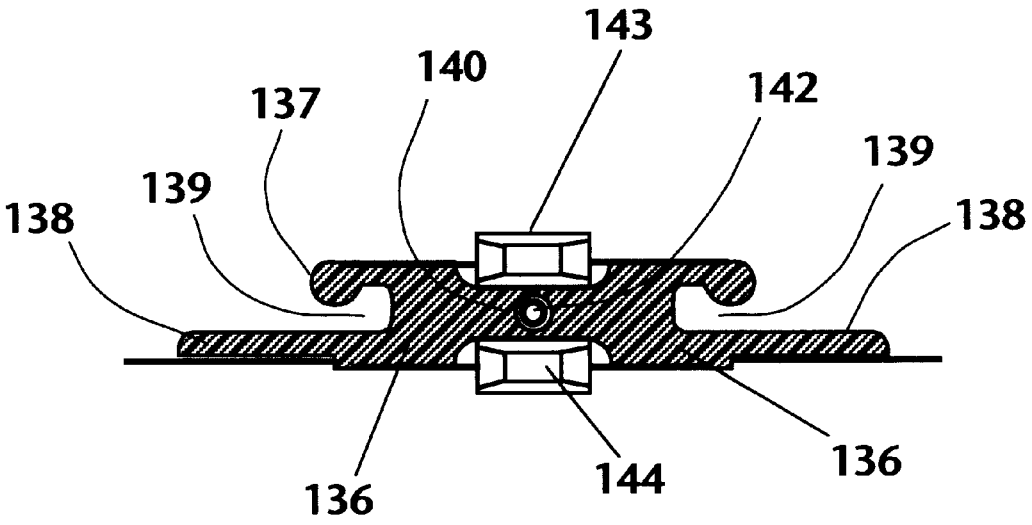
FIG. 22 is a cross-sectional end view of another embodiment of a sealed zipper assembly, shown in a closed configuration.
Figure 23:
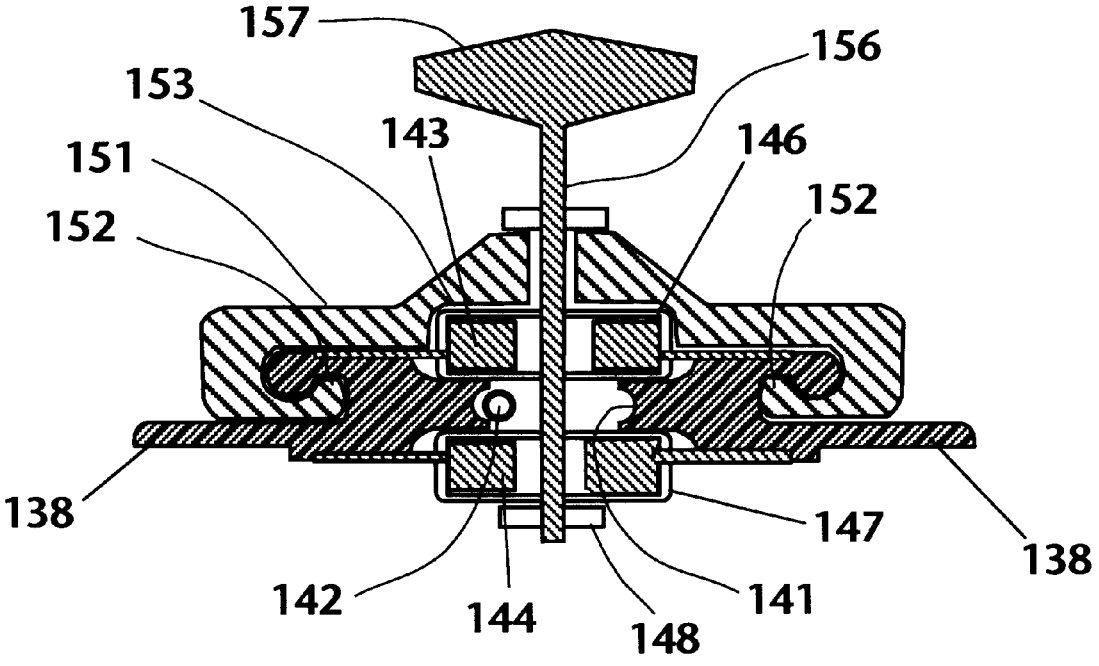
FIG. 23 is a cross-sectional end view of the zipper assembly of FIG. 22 including the main zipper car, shown in an open configuration.

With regard to FIGS. 22 and 23, a further embodiment of the deck zipper 38 or 39 includes a pair of substantially identical sealing elements 136 extending longitudinally and secured to opposed sides of the deck opening. Each sealing element 136 includes at its outer extent a flange 137 extending therealong and spaced apart from a planar base 138 to define therebetween a wide channel 139 having a narrow longitudinal opening. At the inner extent of each sealing element 136 a semi-cylindrical groove 141 extends the length thereof. The two grooves 141 of the two elements 136 are disposed in adjacent, confronting relationship to define together a generally cylindrical chamber 140 when the elements 136 are brought into impingement, as in FIG. 22. A longitudinally extending seal 142 extends the length of the sealing elements 136 and is disposed between the confronting inner surfaces thereof. When the two elements 136 are impinging, the seal 142 is held compressively in the chamber 140 to form a waterproof, leakproof closure. The seal 142 may comprise a tubular element or an extruded shape that is formed in complementary fashion to the sidewalls of the chamber 140.

Figure 24:
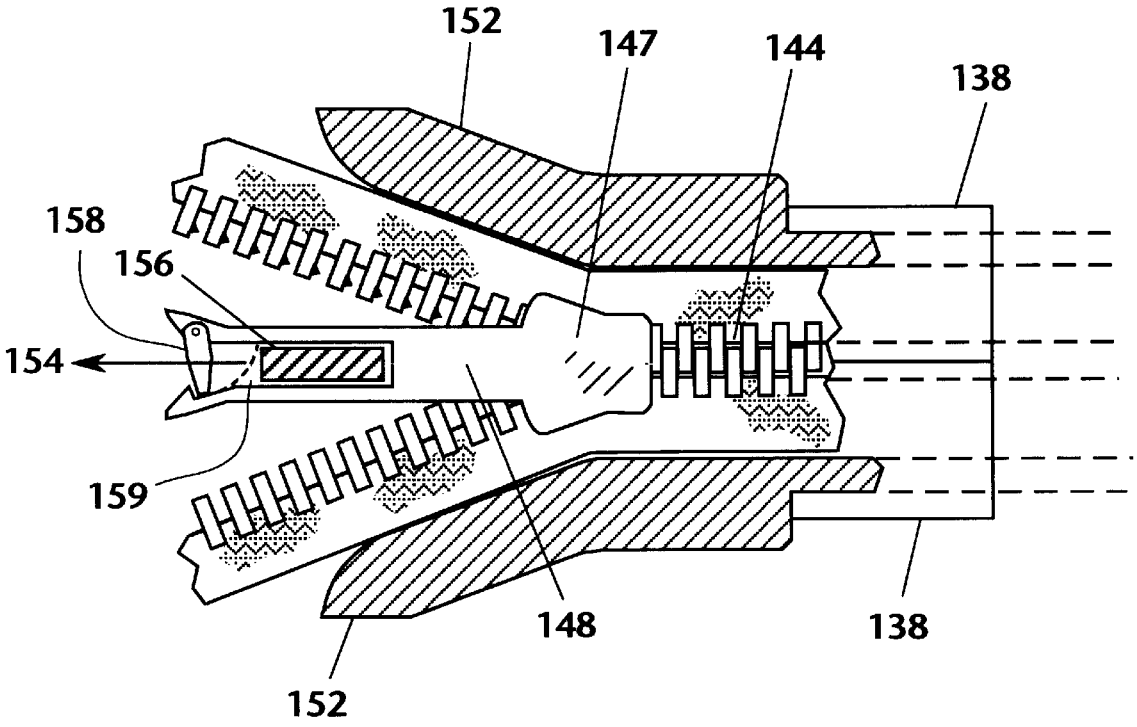
FIG. 24 is a plan view of the zipper assembly of FIGS. 22 and 23.
Figure 25:
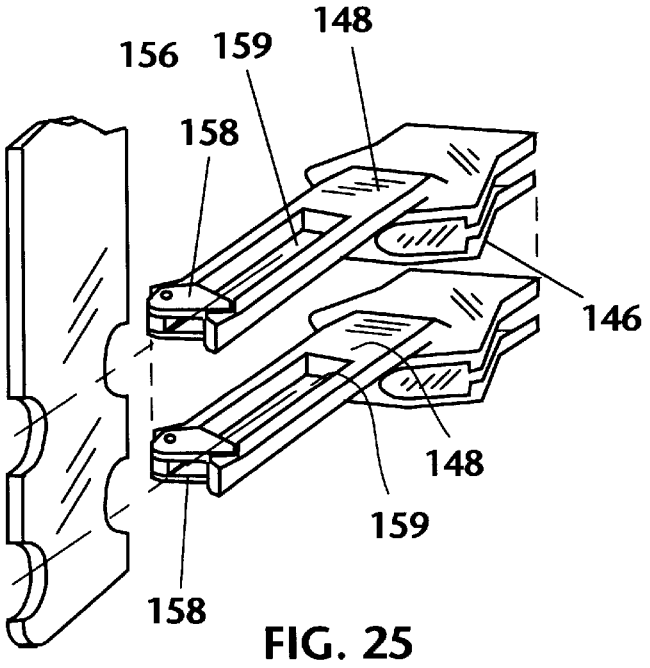
FIG. 25 is a detailed view of the zipper assembly of FIGS. 22–24, showing the linking pin joining one of the zipper pull tabs.

The like sides of a pair of conventional zipper assemblies 143 and 144 are secured to the upper and lower extents of the sealing elements 136, each zipper assembly includes a zipper car 146 and 147, respectively. The toggles 148 of the zipper cars 146 and 147 extend fixedly and forwardly therefrom, as shown in FIG. 24. Simultaneous actuation of the cars 146 and 147 is carried out to draw the sealing elements 136 together and form a sealed closure, the two zippers applying a balanced compressive force that aligns the two elements 136 and captures the seal 142 therebetween.

To actuate the two zipper cars 146 and 147 in concert, there is provided a supercar 151. The supercar 151 includes a laterally extending body having opposed sides provided with a pair of longitudinally extending flanges 152. The flanges 152 are dimensioned to be received in the channels 139 in slidable fashion, and are disposed at convergent angles as shown in FIG. 24, so that the flanges 152 cause the two sealing elements 136 to converge as the supercar 151 translates in the direction of the arrow 154. The supercar includes an interior space that accommodates with clearance the teeth of the upper zipper assembly 143.

A blade-like toggle pin 156 extends through the supercar 151, the upper end of the toggle pin 156 includes a handle 157 for manual grasping. Each zipper toggle 148 includes a slot 159 extending therein and opening forwardly. A latch 158 is secured at the forward opening of each slot 159 in carabiner fashion to releasably retain the toggle pin 156 in each slot 159. Manual pulling on the handle 157 in the longitudinal direction 154 causes the supercar 151 to translate along the seal assembly and draw together the two sealing elements 136 in a common plane, while at the same time causing the upper and lower zipper cars 146 and 147 to translate in concert with the supercar 151 and join the respective upper and lower zippers 143 and 144 to secure the sealing elements in abutting relationship with the seal 142 entrained therebetween.

To effect a tight seal, the toggle pin 156 may be disengaged from the lower zipper toggle 148 and pulled upwardly clear of the sealing elements 136, so that the supercar 151 may be fully translated to close the sealing elements together at the ends thereof and complete the seal. The toggle pin 156 may be guided to reinsert into the slots 159 of the toggles 148 when the seal assembly is to be opened by pushing the toggle pin 156 against the latches 158.

With regard to FIGS. 3 and 4, a further embodiment of the watercraft of the invention comprises a boat 161 having many features similar to the previous embodiment and provided with the same reference numerals modified with a prime (') designation. A significant distinction is the provision of a deck 162 comprised of a panel that has sufficient rigidity to be form-retaining. The deck 162 is removably secured to the hull assembly by sealed zipper assemblies 164 and 166 that extend along the gunwales from the bow 32' to the the stern 33'. The panel deck structure can support greater vertical loading and can transmit longitudinal compression forces from bow and stem to midship, so that the boat 161 may not require the longitudinal struts 103 of the previous embodiment. However, the hull spreaders 108 and end plates 104 are desirable to properly support the hull assembly, and the struts 103 may be included for their role in supporting these components. Moreover, the use of a removable panel deck eliminates the need for a cockpit coaming, as shown in the previous embodiment. However, the removable deck is sufficiently flexible to be rolled into a storage configuration, in the same fashion as the hull panels.

Figure 17:
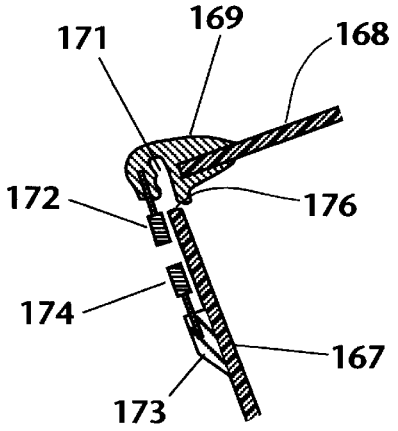
FIG. 17 is a cross-sectional end view of one embodiment of a sealed zipper for joining the hull and deck panels of the folding boat, shown in an open configuration.
Figure 18:
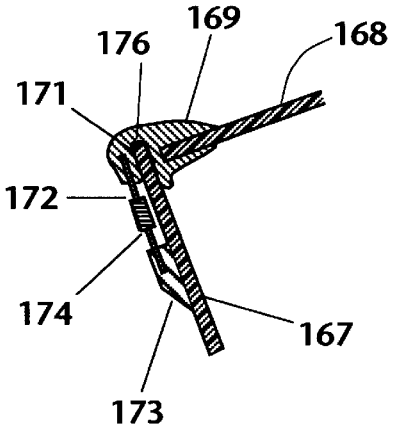
FIG. 18 is a cross-sectional end view of the sealed zipper of FIG. 17, shown in the closed configuration.

With regard to FIGS. 17 and 18, the zipper assemblies 164 and 166 are illustrated with reference to panels 167 and 168, either of which may be the deck panel or hull panel. A sealing gasket 169 extends longitudinally and is bonded to the edge of the panel 168 so that it protrudes outwardly therefrom. A channel 171 is formed longitudinally in the gasket 169 and is dimensioned to receive therein a continuous edge portion of the panel 167. One side portion 172 of a standard zipper assembly is bonded to the sealing gasket 169 so that it extends parallel to the channel 171 and offset slightly therefrom.

Joined to the outer surface of the panel 167 is a mounting strip 173 which is spaced apart from the edge 176 of the panel 167. The other side portion 174 of the zipper assembly is secured to the mounting strip and disposed to extend toward the edge 176 of the panel 167. As shown in FIG. 18 the edge 176 is urged into the channel 171 of the sealing gasket 169 as the zipper side portions 172 and 174 are joined by the zipper sliding car. When the zipper is fully joined, the edge 176 is maintained in the channel 171, whereby a sealed conjunction of the two panels is formed. It may be appreciated that this form of zipper seal is superior in that a great amount of the shear stress and tension applied between the panels 168 and 167 is borne by the sealing gasket, while some of the loading on the zipper assembly is alleviated.

In the embodiments described herein, it may be advantageous or necessary to provide more that two frame assemblies 51, depending on the length, beam, load factor, and other design parameters of the craft. Likewise, a plurality of vertical columns 106 may be provided both fore and aft, and a plurality of hull spreaders 108 may likewise be employed to maintain the desired curvature of the hull panels. The interior furnishings for the watercraft, such as a passenger seat, flotation cells, storage bags, and the like have not been shown, but may be fitted by any individual having ordinary skill in the art.

The boat components described herein may be used to construct a boat that is adapted to be erected and disassembled as necessary, or they may be used to form a boat kit that is sold and shipped in knock-down form and assembled once to comprise a finished boat that is not adapted for disassembly.

The various innovations embodied in the boat constructions 31 and 161 of the invention are considered as well to be separate inventions that are applicable to a wide range of uses. The foldable, form-retaining panel assembly of the hull and deck may be applied to constructing shelters, knock-down buildings, aircraft, and the like. The cam-action frame assemblies 51 may be applied to aircraft or other knock-down vehicle construction in which a flexible outer covering must be supported by an internal framework and must be assembled under tension to that framework. Likewise, the frame assemblies 51 may be used to support spoilers or fairings for wheeled vehicles, tent constructions, and the like. The various waterproof zipper closure embodiments may be applied to dry storage bags, knock-down building constructions, kit structures, automotive uses, and the like.

What is claimed is:

1. A boat assembly, comprising:

a pair of bendable hull panels having longitudinal keel edges, and flexible hinge means for joining said longitudinal keel edges to form a flexible hull assembly;

said hull panels each including a gunwale edge, and further including deck means secured to said gunwale edges of said hull assembly to enclose bow and stem portions of said hull assembly;

panel stiffener means secured to interior surfaces of said hull panels and adapted temporarily increase stiffness and rigidity of selected portions of said hull panels;

at least one cam-action frame assembly removably disposed within said hull assembly, said cam-action frame assembly including means for both applying tension between said gunwale edges of said hull panels and imparting a desired convex curvature to said hull panels;

a cockpit coaming extending across laterally opposed portions of said gunwale edges of said hull panels, said cockpit coaming defining a cockpit opening for a passenger; and, longitudinal strut means extending from said bow and stern of said hull assembly to said cockpit coaming to transmit longitudinal compression forces to said cockpit coaming.

2. A cam-action frame assembly for supporting a flexible outer web, including:

a pair of side braces, said pair of side braces being substantially identical each to the other, each side brace having first and second legs diverging from a common vertex and defining a convex shape;

pivot means for joining like ends of said first legs of said pair of side braces, said pair of side braces being rotatable about said pivot means from an open position in which said common vertices of said pair of side braces are disposed at a maximum spacing therebetween, to a closed position in which said common vertices are disposed at a minimum spacing therebetween and like ends of said second leg portions of said pair of side braces are disposed in mutually abutting relationship.

3. The cam-action frame assembly of claim 2, further including latch means for joining said like ends of said second leg portions disposed in said closed position.

4. The cam-action frame assembly of claim 3, further including means for securing a flexible outer web extending about said cam-action frame assembly, and means for securing said vertices of said pair of side braces to a flexible outer web when said side braces are disposed in said open position, whereby rotating said pair of side braces to said closed position applies tension to the portion of a flexible outer web extending between said vertices.

5. The cam-action frame assembly of claim 4, wherein said first legs of said pair of side braces are provided with outer convex curvature, whereby said portion of said flexible outer web is caused to conform to said outer convex curvature.

6. A boat construction adapted to be transformed from a disassembled state to an assembled watercraft capable of buoyant navigation, comprising:

a hull assembly adapted to be disposed in a first disposition in which said hull assembly is collapsed and folded into a storage configuration, and transformable into a second disposition in which said hull assembly is deployed as a water-displacing hull;

frame means comprised of disassemblable frame components adapted to be disposed in a knock-down state and adapted to be assembled within said water-displacing hull to support said water-displacing hull; and, deck means secured to said hull assembly and disposed to enclose upper portions of said water-displacing hull;

said hull assembly including a pair of hull panels having confronting curved longitudinal edges, and first means for joining said hull panels continuously along said longitudinal edges;

said frame means including at least a pair of cam-action frame assemblies adapted to be received within said water-displacing hull and to extend transversely to said hull panels and define a rigid structure therebetween.

7. The boat construction of claim 6, wherein each of said cam action frame assemblies includes a pair of side components, said pair of side components being substantially identical each to the other.

8. The boat construction of claim 7, wherein each side component includes a first leg portion and a second leg portion, said first and second leg portions extending from a common vertex at an included angle to define a generally convex structure.

9. The boat construction of claim 8, wherein said first leg portion is provided with a generally convex curve, and said second leg portion is provided with a generally straight conformation.

10. The boat construction of claim 9, further including second hinge means for joining like ends of said first leg portions of said pair of side components, said pair of side components being rotatable about said hinge means from an open frame position in which said common vertices of said side components are disposed at a maximum spacing therebetween, to a closed frame position in which said common vertices of said side components are disposed at a minimum spacing therebetween and like ends of said second leg portions of said pair of side components are disposed in abutting relationship.

11. The boat construction of claim 10, further including latch means for joining said like ends of said second leg portions disposed in said closed frame position.

12. The boat construction of claim 10, wherein said hull panels include a pair of longitudinally extending gunwale edges, and further including means for removably joining each of said vertices of said side components to one of said gunwale edges when said side components are disposed in said open frame position, said side components being rotatable to said closed position to apply tension between said gunwale edges and to impinge said curved legs of said pair of side components against said pair of hull panels, thereby imparting a predetermined convex curvature to said hull panels.

13. The boat construction of claim 6, wherein said frame assemblies are spaced apart longitudinally in said water-displacing hull, and further including a cockpit coaming having longitudinally opposed ends supported by said frame assemblies.

14. The boat construction of claim 13, wherein said cockpit coaming includes laterally opposed side edges extending to opposed upper edge portions of said water-displacing hull.

15. The boat construction of claim 13, wherein said cockpit coaming includes compression column means for receiving and transferring compression forces between said opposed ends of said cockpit coaming.

16. The boat construction of claim 15, wherein said water-displacing hull includes longitudinally opposed ends, and further including a pair of longitudinal strut means extending from said opposed ends of said water-displacing hull to said cockpit coaming to support longitudinal compressive forces in said water-displacing hull and transfer said longitudinal compressive forces to said compression column means of said cockpit coaming.

17. The boat construction of claim 16, wherein said longitudinal strut means includes a pair of longitudinal strut assemblies having like inner ends, and means for releasably connecting said like inner ends of said longitudinal strut assemblies to said cockpit coaming.

18. The boat construction of claim 17, wherein each longitudinal strut assembly includes an outer end, and a curved end plate secured to said outer end, said curved end plate conformed in complementary fashion to the curvature of the respective end of said water-displacing hull.

19. The boat construction of claim 18, further including at least one vertical column having an upper end secured to said longitudinal strut assembly and a lower end impinging on a keel portion of said water-displacing hull.

20. The boat construction of claim 19, further including at least one hull spreader strut having a medial portion secured to said vertical column and laterally opposed ends impinging on said hull panels of said water-displacing hull.

21. The boat construction of claim 15, wherein said cockpit coaming is comprised of a pair of coaming panels substantially identical each to the other, and third hinge means for joining said coaming panels along a longitudinal axis.

22. The boat construction of claim 21, wherein said coaming panels include a pair of concave openings disposed in confronting relationship along said longitudinal axis to define together a cockpit opening.

23. The boat construction of claim 22, wherein said compression column means includes a compression column extending longitudinally in each of said coaming panels.

24. The boat construction of claim 23, wherein each of said coaming panels includes a pair of transverse webs extending from said longitudinal axis to said compression column, said pair of transverse webs being disposed at longitudinally opposed ends of said coaming panel.

25. The boat construction of claim 14, wherein said hull panels include opposed gunwale edges, and said cockpit coaming includes a pair of outer flanges at said laterally opposed side edges to extend over and engage portions of said gunwale edges of said hull panels.

26. The boat construction of claim 25, further include a pair of strap assemblies secured to said hull panels and disposed to extend about and secure the upper extent of said cockpit coaming to said water-displacing hull.

27. A boat construction adapted to be transformed from a disassembled state to an assembled watercraft capable of buoyant navigation, comprising:

a hull assembly adapted to be disposed in a first disposition in which said hull assembly is collapsed and folded into a storage configuration, and transformable into a second disposition in which said hull assembly is deployed as a water-displacing hull;

frame means comprised of disassemblable frame components adapted to be disposed in a knock-down state and adapted to be assembled within said water-displacing hull to support said water-displacing hull; and, deck means secured to said hull assembly and disposed to enclose upper portions of said water-displacing hull;

said hull assembly including a pair of hull panels having confronting curved longitudinal edges, and first means for joining said hull panels continuously along said longitudinal edges;

panel stiffener means secured to said hull panels for increasing the stiffness and rigidity of selected portions of said hull panels;

said panel stiffener means including a welt secured permanently to a surface of one of said hull panels and extending in a first direction, a bore extending through said welt in said first direction, and a stiffener member removably secured in said bore.

28. The boat construction of claim 27, wherein said stiffener member comprises a generally tubular rigid member extending substantially the entire length of said bore.

29. The boat construction of claim 27, wherein said panel stiffener means includes a plurality of paired brackets secured to a surface of one of said hull panels and extending in a first direction in a generally linear arrangement, and a substantially rigid stiffener member adapted to be slidably engaged by said paired brackets.

30. The boat construction of claim 29, wherein said stiffener member includes at least one side portion extending in said first direction, said paired bracket members adapted to capture therebetween said at least one side portion in slidable fashion.

31. The boat construction of claim 30, wherein said stiffener member includes a medial web member joined to said at least one side portion and extending in said first direction.

32. The boat construction of claim 31, wherein said stiffener member includes another side portion joined to said web member in parallel, spaced apart relationship to said at least one portion.

33. The boat construction of claim 32, wherein said another side portion comprises a curved panel member having, opposed edges, said opposed edges impinging on said surface of said hull panel.

34. A boat construction adapted to be transformed from a disassembled state to an assembled watercraft capable of buoyant navigation, comprising:

a hull assembly adapted to be disposed in a first disposition in which said hull assembly is collapsed and folded into a storage configuration, and transformable into a second disposition in which said hull assembly is deployed as a water-displacing hull;

frame means comprised of disassemblable frame components adapted to be disposed in a knock-down state and adapted to be assembled within said water-displacing hull to support said water-displacing hull; and, deck means secured to said hull assembly and disposed to enclose upper portions of said water-displacing hull;

said hull assembly including a pair of hull panels having confronting curved longitudinal edges, and first means for joining said hull panels continuously along said longitudinal edges;

said hull panels including opposed gunwale edges and a bow end and a stern end;

said deck means including a flexible, collapsible deck cover spanning the distance between said gunwale edges and secured permanently thereto, said deck cover extending from said bow end to said stern end;

further including at least one deck access opening extending generally longitudinally in said deck cover to permit installation of said frame means, and closure means for closing said deck access opening in sealed, leakproof fashion.

35. The boat construction of claim 34 wherein said deck access opening includes laterally opposed sides, and said closure means includes a pair of seal welts, each secured to one of said laterally opposed sides.

36. The boat construction of claim 35, wherein said pair of seal welts include complementary, mating surfaces adapted to be releasably engaged in sealing fashion, said mating surfaces extending longitudinally on said pair of seal welts in confronting, opposed relationship.

37. The boat construction of claim 36, further including zipper means joined to said seal welts to releasably engage and disengage said mating surfaces of said pair of seal welts.

38. The boat construction of claim 37, wherein one of said mating surfaces of said seal welts comprises a channel extending longitudinally, and the other of said mating surfaces comprises a rib extending longitudinally, said rib adapted to be releasably and sealingly received in said channel.

39. The boat construction of claim 38, wherein said zipper means includes a zipper having laterally opposed, paired sides, each of said zipper sides being secured to one of said pair of seal welts, and a zipper car slidably secured to said paired sides.

40. The boat construction of claim 39, wherein said mating surfaces of said seal welts comprise a pair of arcuate, concave channels extending longitudinally, said mating surfaces adapted to be brought into impingement whereby said channels define a longitudinally extending closed chamber.

41. The boat construction of claim 40, further including a seal element disposed between said mating surfaces and dimensioned to be received in said closed chamber in seal-forming fashion.

42. The boat construction of claim 41, wherein said zipper means includes a pair of zipper assemblies, each zipper assembly having a pair of laterally opposed sides, each side secured to one of said seal welts.

43. The boat construction of claim 42, wherein said pair of zipper assemblies are disposed in parallel, spaced apart, longitudinally extending fashion, said mating surfaces of said seal welts disposed between said pair of zipper assemblies.

44. The boat construction of claim 43, wherein said pair of zipper assemblies each include a sliding zipper car secured to said laterally opposed sides.

45. The boat construction of claim 44, further including linking means for joining said sliding zipper cars of said pair of zipper assemblies for sliding movement in unison.

46. The boat construction of claim 45, further including a supercar member, said supercar member including means for slidably engaging said pair of seal welts and urging said pair of seal welts to converge together upon sliding supercar translation in one longitudinal direction and to diverge upon sliding super translation in the opposite longitudinal direction.

47. The boat construction of claim 46, wherein said linking means includes a toggle pin extending from said supercar member and joined to said zipper cars of said pair of zipper assemblies.

48. The boat construction of claim 47, further including means for selectively releasing one of said zipper cars of said pair of zipper assemblies from said toggle pin.

49. A boat construction adapted to be transformed from a disassembled state to an assembled watercraft capable of buoyant navigation, comprising:

a hull assembly adapted to be disposed in a first disposition in which said hull assembly is collapsed and folded into a storage configuration, and transformable into a second disposition in which said hull assembly is deployed as a water-displacing hull;

frame means comprised of disassemblable frame components adapted to be disposed in a knock-down state and adapted to be assembled within said water-displacing hull to support said water-displacing hull; and, deck means secured to said hull assembly and disposed to enclose upper portions of said water-displacing hull;

said hull assembly including a pair of hull panels having confronting curved longitudinal edges, and first means for joining said hull panels continuously along said longitudinal edges;

said hull panels including opposed gunwale edges and a bow end and a stern end, said deck means including a form-retaining deck panel spanning the distance between said gunwale edges and extending from said bow end to said stern end;

means for releasably joining said deck panel to said gunwale edges of said hull panels;

said deck panel including laterally opposed, longitudinally extending edges, and said means for releasably joining secures said longitudinally extending edges to said gunwale edges;

said means for releasably joining including a seal welt joined permanently to one of said longitudinally extending edges.

50. The boat construction of claim 49, wherein said seal welt includes a channel extending longitudinally therein, said channel dimensioned to receive a portion of said gunwale edge of one of said hull panels in sealing fashion.

51. The boat construction of claim 50, further including zipper means for releasably securing said portion of said gunwale edge in said channel of said seal welt.

52. The boat construction of claim 51, wherein said zipper means includes opposed side portions, one side portion joined to said seal welt, the other side portion joined to said hull panel and extending longitudinally adjacent to said portion of said gunwale edge.

53. The boat construction of claim 52, further including a mounting strip secured to said hull panel adjacent to said portion of said gunwale edge and adapted to secure said other side portion of said zipper to said hull panel.

54. The boat construction of claim 50, wherein said channel extend into said seal welt generally orthogonally to said deck panel.

55. A panel stiffening assembly for selectively increasing the rigidity and stiffness of selected portions of a flexible panel, comprising:

a plurality of paired brackets secured to a surface of the flexible panel and extending in a first direction in a generally linear arrangement, and a substantially rigid stiffener member adapted to be slidably engaged by said paired brackets;

said stiffener member including at least one side portion extending in said first direction, said paired bracket members adapted to capture therebetween said at least one side portion in slidable fashion;

said stiffener member including a medial web member joined to said at least one side portion and extending in said first direction;

said stiffener member including another side portion joined to said web member in parallel, spaced apart relationship to said at least one portion;

said another side portion comprising a curved panel member having opposed edges, said opposed edges impinging on said surface of said flexible panel.

56. A sealed zipper closure for an opening having laterally opposed sides, comprising:

a pair of seal welts, each secured to one of said laterally opposed sides;

said pair of seal welts including complementary, mating surfaces adapted to be releasably engaged in sealing fashion, said mating surfaces extending longitudinally on said pair of seal welts in confronting, opposed relationship;

zipper means joined to said seal welts to releasably engage and disengage said mating surfaces of said pair of seal welts;

said zipper means including a zipper having laterally opposed, paired sides, each of said zipper sides being secured to one of said pair of seal welts, and a zipper car slidably secured to said paired sides;

said mating surfaces of said seal welts comprising a pair of arcuate, concave channels extending longitudinally, said mating surfaces adapted to be brought into impingement whereby said channels define a longitudinally extending closed chamber.

57. The sealed zipper closure of claim 56, further including a seal element disposed between said mating surfaces and dimensioned to be received in said closed chamber in seal-forming fashion.

58. The sealed zipper closure of claim 57, wherein said zipper means includes a pair of zipper assemblies, each zipper assembly having a pair of laterally opposed sides, each side secured to one of said seal welts.

59. The sealed zipper closure of claim 58, wherein said pair of zipper assemblies are disposed in parallel, spaced apart, longitudinally extending fashion, said mating surfaces of said seal welts disposed between said pair of zipper assemblies.

60. The sealed zipper closure of claim 59, wherein said pair of zipper assemblies each include a sliding zipper car secured to said laterally opposed sides.

61. The sealed zipper closure of claim 60, further including linking means for joining said sliding zipper cars of said pair of zipper assemblies for sliding movement in unison.

62. The sealed zipper closure of claim 61, further including a supercar member, said supercar member including means for slidably engaging said pair of seal welts and urging said pair of seal welts to converge together upon sliding supercar translation in one longitudinal direction and to diverge upon sliding super translation in the opposite longitudinal direction.

63. The sealed zipper closure of claim 62, wherein said linking means includes a toggle pin extending from said supercar member and joined to said zipper cars of said pair of zipper assemblies.

64. A boat construction adapted to be transformed from a disassembled state to an assembled watercraft capable of buoyant navigation, comprising:

a hull assembly adapted to be disposed in a first disposition in which said hull assembly is collapsed and folded into a storage configuration, and transformable into a second disposition in which said hull assembly is deployed as a water-displacing hull;

frame means comprised of disassemblable frame components adapted to be disposed in a knock-down state and adapted to be assembled within said water-displacing hull to support said water-displacing hull; and, deck means secured to said hull assembly and disposed to enclose upper portions of said water-displacing hull;

said hull assembly including a pair of hull panels having confronting curved longitudinal edges, and first means for joining said hull panels continuously along said longitudinal edges;

said first means including a web portion extending between said curved longitudinal edges, said web portion being capable of bending about a vertex extending between said curved longitudinal edges of said hull panels whereby said hull panels may be moved angularly about said vertex between a knock-down position in which said hull panels are confronting and impinging, and an expanded position in which said hull panels diverge angularly from said vertex;

said web portion further being capable of bending in a second angular direction that is generally transverse to said first angular direction, whereby said hull panels in said knock-down position are bendable about an axis generally transverse to said first angular direction, and said hull panels may be moved between said knock-down position in which said hull panels are confronting and impinging to a rolled configuration in which said impinging hull panels are bent in said second angular direction into a storage configuration.

65. The boat construction of claim 64, wherein said hull panels include opposed gunwale edges and a bow end and a stern end, and said deck means includes a form-retaining flexible deck panel spanning the distance between said gunwale edges and extending from said bow end to said stem end, said deck panel including a longitudinally extending continuous perimeter edge, and means for releasably joining and sealing said longitudinally extending continuous perimeter edge of said deck panel to said gunwale edges of said hull panels.

66. The boat construction of claim 51, wherein said deck panel includes laterally opposed, longitudinally extending edges, and said means for releasably joining secures said longitudinally extending edges to said gunwale edges.

* * * * *